US005676409A

United States Patent [19]

Trammell, Jr.

[11] Patent Number: 5,676,409

[45] Date of Patent: Oct. 14, 1997

[54] CHILD-SAFETY POWER DOOR LOCKING SYSTEM

[76] Inventor: Earl M. Trammell, Jr., 2224 Village Green Pkwy., Chesterfield, Mo. 63017

[21] Appl. No.: 534,642

[22] Filed: Sep. 27, 1995

[51] Int. Cl.[6] ..... E05B 3/00; E05B 1/00

[52] U.S. Cl. ..... 292/336.3; 292/347; 292/DIG. 31; 292/DIG. 65

[58] Field of Search ..... 292/336.3, 347, 292/DIG. 30, DIG. 31, DIG. 65

[56] References Cited

U.S. PATENT DOCUMENTS

| | | | |
|---|---|---|---|
| 2,046,342 | 7/1936 | Muck et al. | 292/352 |
| 2,163,101 | 6/1939 | Newton | 292/347 |
| 2,694,917 | 11/1954 | Trammell, Jr. | 70/174 |
| 2,708,845 | 5/1955 | Trammell, Jr. | 70/181 |
| 2,735,288 | 2/1956 | Trammell, Jr. | 70/135 |
| 2,735,289 | 2/1956 | Trammell, Jr. | 70/181 |
| 2,742,314 | 4/1956 | Santos | 292/336.3 |
| 2,939,307 | 6/1960 | Trammell, Jr. | 70/181 |
| 2,939,308 | 6/1960 | Trammell, Jr. | 70/210 |
| 2,955,858 | 10/1960 | Trammell, Jr. | 292/1 |
| 3,096,114 | 7/1963 | Trammell, Jr. | 292/336.3 |
| 3,109,900 | 11/1963 | Van Hook | 200/43.19 |
| 4,143,896 | 3/1979 | Giancaterino | 292/347 |
| 4,185,178 | 1/1980 | Drees | 200/42 |
| 4,487,441 | 12/1984 | Miyamoto et al. | 292/336.3 |
| 4,492,395 | 1/1985 | Yamada | 292/216 |
| 4,778,207 | 10/1988 | Gergoe | 292/336.3 |

FOREIGN PATENT DOCUMENTS

| | | | |
|---|---|---|---|
| 4023822 | 1/1992 | Germany | 292/DIG. 65 |

*Primary Examiner*—Steven N. Meyers
*Assistant Examiner*—Donald J. Lecher
*Attorney, Agent, or Firm*—Senniger, Powers, Leavitt & Roedel

[57] ABSTRACT

A door locking system for child-safety door locking systems on an automobile includes, in combination, an automobile door including a latch and a door lock mechanism, a manual door lock actuator and a power door locking mechanism. The door handle is of the type which is incapable unlatching the door when the locking mechanism locks the latch. The door panel has an opening for receiving the manual lock actuator when moved to its locked position so that the manual lock actuator is substantially recessed within the door panel. The manual lock actuator and the door panel are constructed such that the manual lock actuator cannot be accessed through the opening for manual movement back to its unlocked position. The power lock mechanism can be actuated to unlock the door, but only from a location which is remote from the door itself.

4 Claims, 6 Drawing Sheets

CHILD-SAFETY POWER DOOR LOCKING SYSTEM

BACKGROUND OF THE INVENTION

This invention relates generally to door locking systems, and more particularly to standard equipment child-safety door locking systems for automobile doors.

There are presently systems which prevent the rear doors of automobiles from being unlocked and opened by children while the automobile is in motion. At present, all major car makers are incorporating as standard equipment a child-safety locking system of European origin that consists of adding a separate mechanical unit to the rear doors in addition to the regular locking unit. This child safety locking unit has a small lever that is positioned on the face of the door panel which requires that the door be opened to access the lever. The child safety locking unit requires manual setting for (1) normal locking and (2) child-safety locking. Normal locking permits the door to be locked, unlocked and opened by manipulation of the regular locking unit and door latch from inside the vehicle. However when child safety locking is activated, the door becomes totally inoperable from the inside whether the regular locking unit is locked or unlocked. The door may then be opened only from the outside, and then only when the regular locking unit is unlocked.

This means that when child safety locking is activated, the driver always has the inconvenience of having to exit the car in order to let the children in the rear out. There is this same aggravation when adults are in the rear and the driver forgets to position the lever to return the door to normal locking. Also, the driver has no visual reference as to whether the rear doors are in a child safety or normal locking mode. The driver must make sure the locking unit of the rear door is unlocked, and either: (1) strain to reach back and check the rear door handles; or (2) exit the car and open the rear door from the outside. Moreover in certain circumstances, such as in an accident where the car rolls upside down, the driver may not be able to unlock or to open the rear door from outside the automobile. The child safety power door locking system of the present invention completely eliminates the above problems and inconveniences as well as providing for other substantial advantages over the present system.

I patented Child-Guard® rear door lock actuator shields in the 1950's (e.g., U.S. Pat. Nos. 2,955,858, 2,694,917, 2,708,845, 2,735,289 and 2,939,307). Power locks were not available at this time. My lock actuator shields were designed and made by my company, E-M-T Enterprises, for General Motors, Ford, Chrysler and American Motors cars, and were sold in volume from 1956 until 1987. Production ceased only in 1991 at which time all automobile manufacturers had incorporated the European child-safety locking system as standard equipment. My Child-Guard® lock actuator shields were confined accessory products, sold only to the major car companies.

Generally speaking, my prior actuator shields have an opening for receiving the manual look actuator in closely spaced relation with the shield. There is too little space between the shield and the lock actuator in the opening to grasp the lock actuator, or even to insert a thin instrument such as a key to pry the lock actuator back to an unlocked position. However, these shields have a slot (i.e., a second opening) in them which is too small for a child's fingers to reach the lock actuator, but which would permit insertion of the car key through the shield to unlock the door. Power door locking was not available on automobiles until the early 1970's. However, sales of my accessory lock shields continued to be strong until the late 1980's when nearly all automobiles began to incorporate the European child safety locking system described previously.

My original child safety manual lock actuator shields were an accessory product that where installed around the standard equipment manual lock actuator and used a key for unlocking. My new child safety power door locking system is standard equipment. It does not use a slotted shield and cannot be manipulated with a car key. The power door locking unit is the sole means for unlocking the door. The new system incorporates the integral action of: (1) normal locking; (2) hand guard shielding; and (3) power door locking, not previously found in child-safety door locking systems.

SUMMARY OF THE INVENTION

The present invention introduces to the automobile maker a new standard equipment child-safety locking system that operates in direct combination with power door locking systems on all makes of new cars. The new system incorporates the integral action of: (1) normal locking; (2) hand guard shielding; and (3) power door locking not heretofore available in combination. The new child-safety locking system provides for definite improvements over the European child safety locking system that is now being used as standard equipment by all the major car manufacturers. Specifically, this new system will be mechanically simpler, cost less and also be more dependable and convenient to operate. There is no separate mechanism which must be added to the standard door locking mechanism or the power lock mechanism.

An important feature of this invention is that it will provide the driver with quick, positive and convenient control over child-safety locking and unlocking that was not previously available. The driver can confirm that the system is operating by a quick visual inspection of the doors from the interior of the vehicle. The new system also operates in both a guard mode and a normal or conventional mode in which the door locks can be manually opened at any time. It is easy to change back and forth between guard locking and normal locking.

The new child-safety locking system also protects against rear door break-in. A common way of breaking into current automobiles (both those with and without the European child-safety locking system) which are parked with their windows up is to break the rear window, and to reach in and unlock the door by grasping the manual lock actuator on the rear door. If driving with the rear window down, it is also possible for an intruder to quickly reach in the window and manually unlock the door and open it from the outside. However, my invention makes such an action impossible by shielding the manual lock actuator from being grasped by the intruder.

Among the several objects of this invention may be noted the provision of an improved child-safety door locking system for an automobile which prevents a child from unlocking the door from the inside; the provision of such a door locking system which permits the locked door to be unlocked without exiting the automobile to do so; the provision of such a door locking system which can be activated remotely from the door (e.g., at the front doors); the provision of such a door locking system which is inexpensive; the provision of such a door locking system which can be deactivated for normal locking and unlocking operation of the door; the provision of such a door locking system which is readily made as standard equipment on an automobile; and the provision of such a door locking system which is easy to manufacture and to use.

In general, a door locking system of this invention comprises an automobile door with an interior door panel, a latch, a door handle capable of operating the latch to latch and unlatch the door, and a locking mechanism operable to lock and unlock the latch. The door handle is incapable of operating to unlatch the door when the locking mechanism locks the latch. A manual lock actuator is mounted on the door for manually actuating the locking mechanism to lock and unlock the latch. The manual lock actuator is capable of being moved between a locked position in which the latch on the door is locked and an unlocked position in which the latch on the door is unlocked. The door panel has an opening therein for receiving the manual lock actuator in the locked position so that the manual lock actuator is substantially recessed within the door panel. The manual lock actuator and the door panel are sized and shaped such that the manual lock actuator is in closely spaced relation with the door panel in the opening so that the manual lock actuator cannot be accessed through the opening for manual movement to the unlocked position. The door also includes a power lock actuator for automatically actuating the locking mechanism to lock and unlock the latch from a location remote from the door in the automobile. The power lock actuator is incapable of being activated at the door to unlock the locking mechanism, whereby the door cannot be manually unlocked by operation of the manual lock actuator upon actuation of the locking mechanism to lock the latch.

Another aspect of the present invention is a child-safety locking system adapted for switching between a normal lock mode and a guard lock mode. In the normal lock mode, the manual lock actuator is disposed in the locked position so that the manual lock actuator may be accessed for manually moving the manual lock actuator to the unlocked position. In the guard lock mode, the manual lock actuator is substantially recessed within the door panel in the locked position such that the door cannot be manually unlocked. Switch means is provided to relatively reposition the door panel and manual lock actuator thereby to selectively switch the child-safety locking system between the normal lock mode and the guard lock mode.

Other objects and features will be in part apparent and in part pointed out hereinafter.

BRIEF DESCRIPTION OF THE DRAWINGS

Corresponding parts are indicated by corresponding reference numerals throughout the several views of the drawings.

DETAILED DESCRIPTION OF THE PREFERRED EMBODIMENTS

Figure 1:
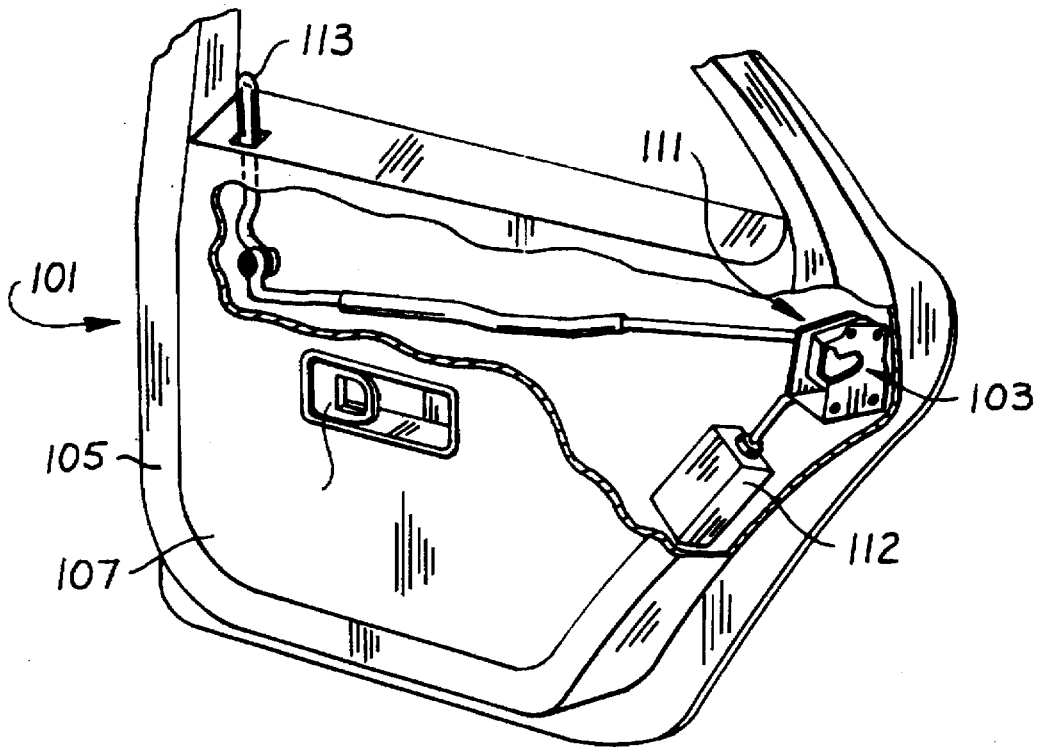
FIG. 1 is a perspective view of an automobile door including a child-safety locking system of a first embodiment including a lock button type manual lock actuator, a door latch, and a power lock actuator.

Now referring to the drawings, specifically FIG. 1, the reference numeral 101 refers generally to a rear or passenger side door of an automobile. A latch, generally indicated at 103 is mounted on the inside of a door frame 105. When the door 101 is closed, the latch 103 engages an automobile frame (not shown) on which the door is mounted to secure the door closed. To open the door 101, the latch 103 is unlatched from the automobile frame. An interior door panel 107 covers the door frame 105. A handle 109 mounted on the interior door panel 107 is connected to the latch 103 in a conventional manner such that it operates to latch and unlatch the door 101. A locking mechanism, shown generally at 111, is connected to the latch 103 such that it is capable of locking and unlocking the latch. When the locking mechanism 111 is in a locked position, it overrides the connection between the handle 109 and the latch 103 so as to render the handle incapable of unlatching the door 101. The construction of the locking mechanism 111 and latch 103 to prevent the handle 109 from being used to unlatch the door 101 when it is locked is well known to those of ordinary skill in the art and will not be described herein. Attached to the locking mechanism 111 is a manual lock actuator 113 extending through the interior door panel 107 to allow manual actuation of the locking mechanism 111 to lock and unlock the latch 103.

Figure 14:
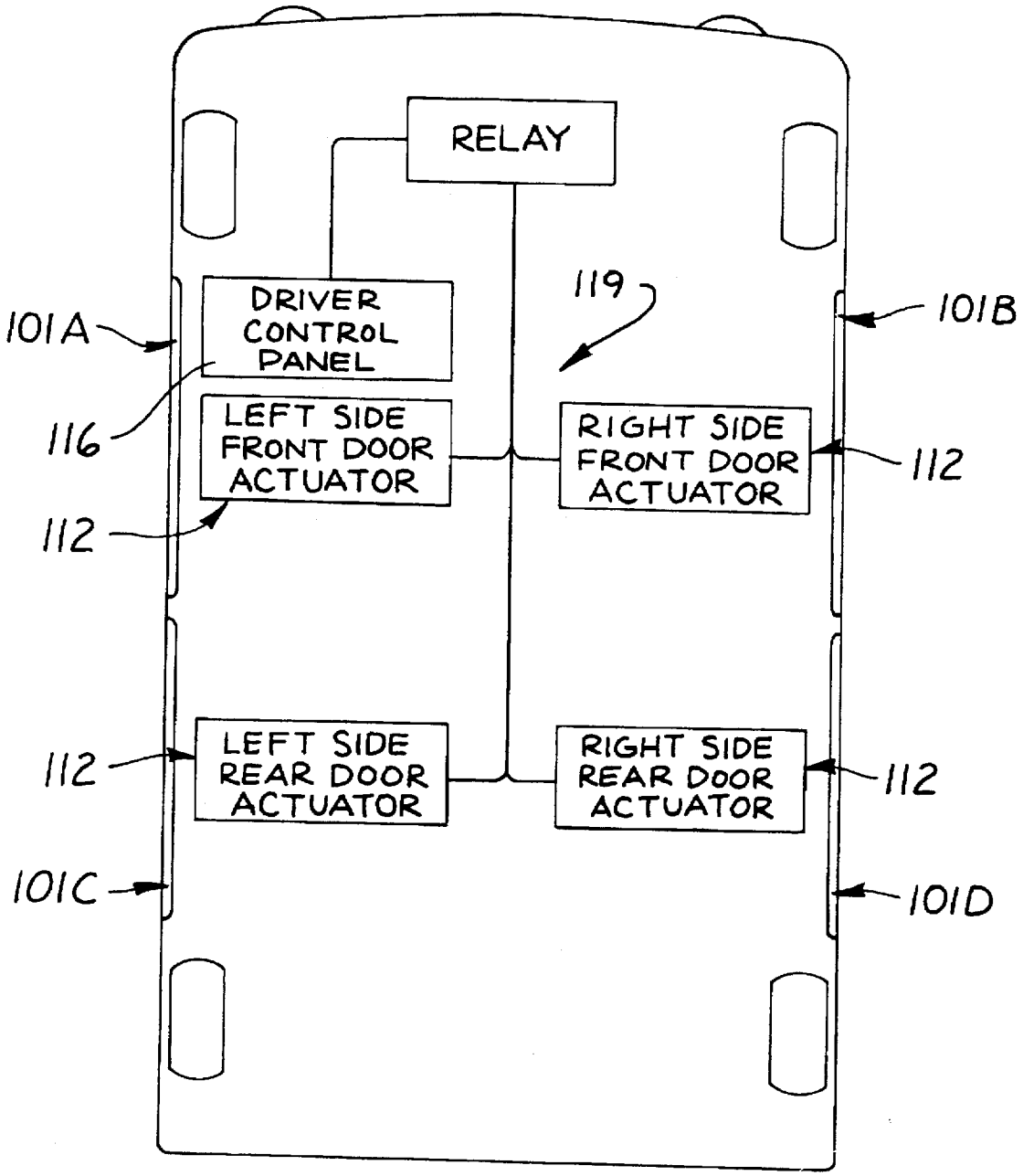
FIG. 14 is a schematic illustrating a power locking system used in the present invention.

An important feature of the locking system of the present invention, in combination with the manual lock actuator 113 and door panel 107, is a power locking system (generally indicated at 119) of the automobile shown schematically in FIG. 14. The power locking system 119 includes a power lock actuator, shown generally at 112, mounted on each of the four doors (designated 101, 101A, 101B, and 101C) of the automobile. The power lock actuator 112 is used to automatically move the locking mechanism 111 to lock and unlock the latch 103. The power lock actuators 112 are connected by electrical wires to a control panel 116 located near the driver's seat. By toggling a switch (not shown) on the control panel 116, the driver is capable of locking and unlocking all of the doors 101–101C. As incorporated in the various embodiments of the locking system described hereinafter, the power locking system 119 is the only means of moving the locking mechanism 111 to unlock the latch 103 on the door 101 when the manual lock actuator 113 is in the locked position in the guard lock mode.

There are six embodiments of the invention disclosed in the figures contained herein. For ease of cross-referencing between embodiments, the first digit of each reference number will correspond to the embodiment shown. The last two digits of each reference number will correspond to the specific item, such that corresponding items appearing in different embodiments are consistently referenced with the only difference in reference numbers being the first digit.

As shown in FIGS. 1–3B, the child-safety locking system of the first embodiment includes a lock button type manual lock actuator 113 screwed onto the end of a lock rod 114. The lock button 113 is generally cylindrical in shape and has an internally threaded hole 115 extending up from its bottom for threading onto a threaded end of the lock rod 114 in an opening 117 in the interior door panel 107. The other end of the lock rod 114 is connected to the locking mechanism 111 such that when the lock button 113 is pushed down to its locked position (FIG. 2B) the locking mechanism locks the latch 103, and when the lock button 113 is pulled up to its unlocked position (FIG. 2A) the locking mechanism unlocks the latch.

Figure 2A:
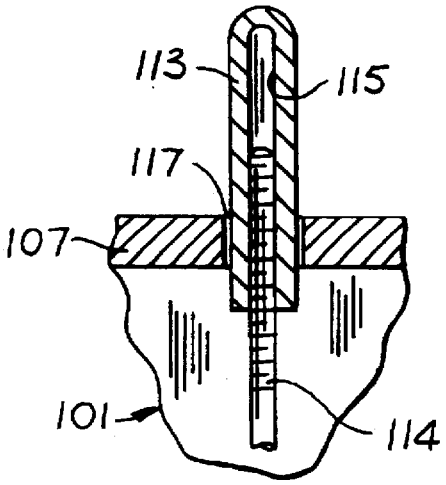
FIGS. 2A and 2B are fragmentary vertical sections of the door showing the lock button in a normal lock mode in its unlocked and locked positions, respectively.
Figure 2B:
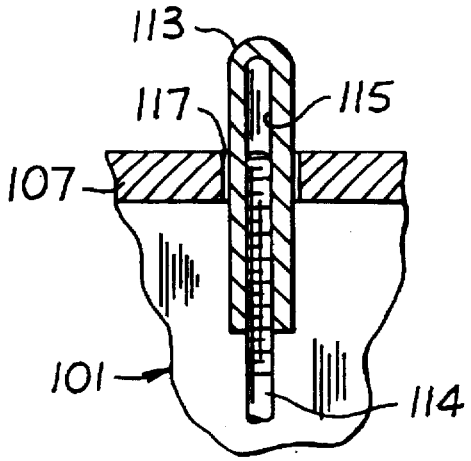
Figure 3A:
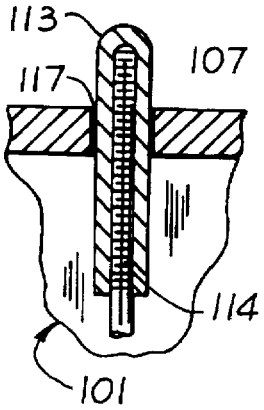
FIGS. 3A and 3B are fragmentary vertical sections of the door showing the lock button in a guard lock mode in its unlocked and locked positions, respectively.
Figure 3B:
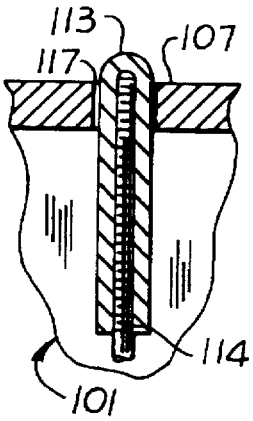

The child-safety locking system of the first embodiment is capable of being selectively switched between a normal lock mode (FIGS. 2A and 2B) and a guard lock mode (FIGS. 3A and 3B). The lock button 113 of the first embodiment is made sufficiently long so that enough threads in the lock button are engaged with the threads of the lock rod 114 when the lock button is screwed only about half way down on the lock to secure the lock button on the lock rod. As shown in FIG. 2B, the lock button 113 projects out of the opening 17 in the interior door panel 107 in its locked position a distance such that the lock button may be manually grasped and moved back to its unlocked position (FIG. 2A).

To switch to its guard lock mode of operation, the lock button 113 is fully screwed onto the lock rod 114 as shown in FIGS. 3A and 3B. When the lock button 113 is in the unlocked position (FIG. 3A), the lock button extends up from the top of the interior door panel 107 as before. However, when pushed down to its locked position (FIG. 3B), the lock button 113 is almost fully recessed through the opening 117 in the top of the interior door panel 107. The lock button 113 and opening 117 in the door panel 107 are sized so that there is very little space between the lock button and the periphery of the opening. Thus in the guard lock mode, the lock button 113 cannot be accessed manually for moving the lock button back to its unlocked position. It is envisioned that structure (not shown) could be provided for releasably fixing the lock button 113 on the lock rod 114 in the normal lock mode and the guard lock mode.

It will be noted that the interior door panel 107 surrounding the opening 117 in which the lock button 113 is positioned is solid. Thus, there are no other openings which provide access to the lock button 113 for manually moving it from its locked position in the guard lock mode to an unlocked position. In that regard, the present invention differs from my prior inventions, described above, in which a slot provided an opening in addition to the opening into which the manual lock actuator recessed for access to the lock button to manually move the lock button back to an unlocked position with the end of a thin, rigid object such as a key. In the present invention there is no opening in addition to the opening 117 so it would not be possible to use a key or similar object to access the lock button 113 in the locked position to manually return it to the unlocked position.

Figure 4A:
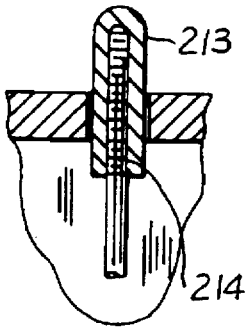
FIGS. 4A and 4B are fragmentary vertical sections of the door, but showing a child-safety locking system of a second embodiment which always operates in the guard lock mode.
Figure 4B:
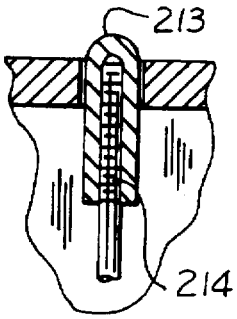

A second embodiment of the child-safety locking system of the present invention shown in FIGS. 4A and 4B comprises a lock button 213 which is substantially shorter than the lock button 113 of the first embodiment so that the lock button 213 operates solely in the guard lock mode. The lock button 213 of the second embodiment can be secured on the lock rod 214 only when the lock button is screwed all the way down onto the lock rod. It will be noted that the lock rod 114 of the first embodiment preferably has more threads than the lock rod 214 of the second embodiment.

Figure 5:
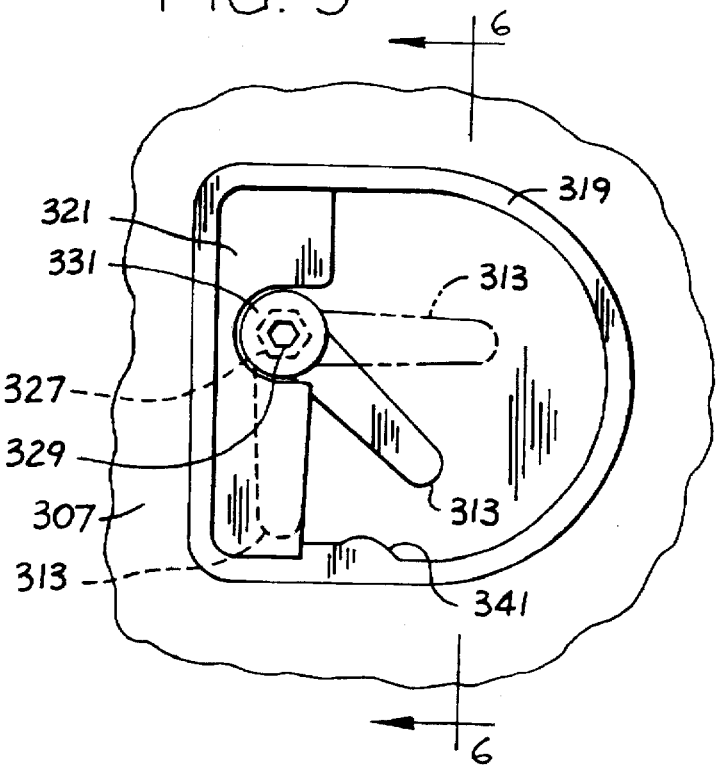
FIG. 5 is a fragmentary elevation of a door showing a lever type manual lock actuator incorporating a child-safety locking system of a third embodiment of the present invention.
Figure 6:
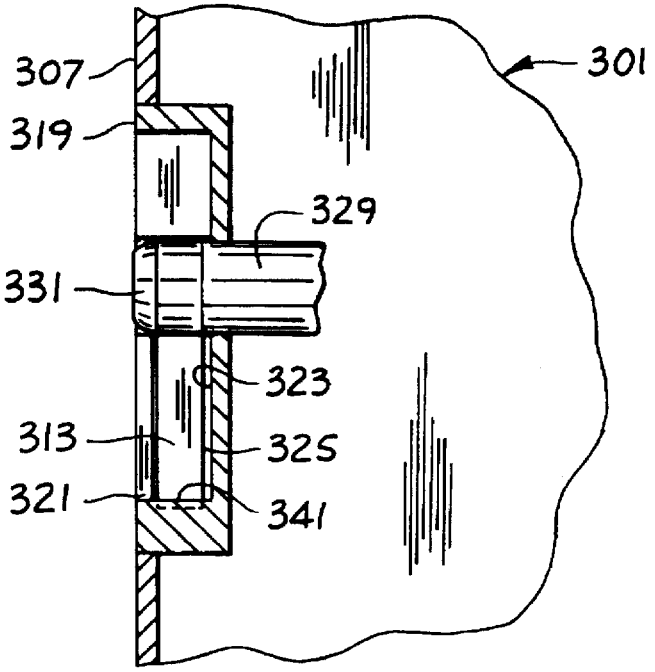
FIG. 6 is a fragmentary section taken in the plane including line 6—6 of FIG. 5 but showing the lock actuator in a guard lock mode in its locked position.
Figure 7:
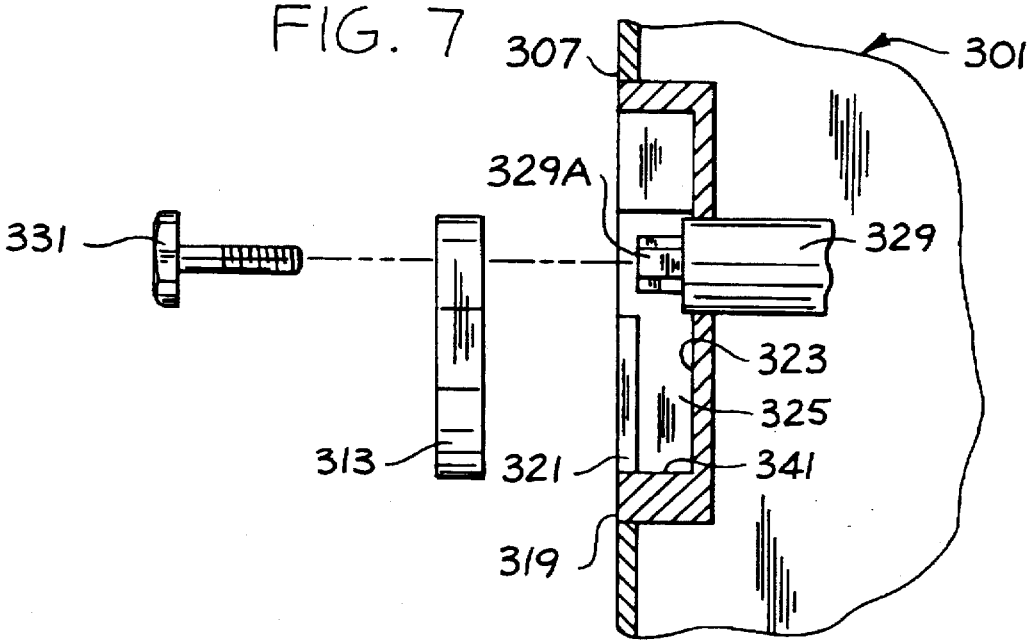
FIG. 7 is similar to FIG. 6 but showing a cap screw and lever exploded from a lock rod and the manual lock actuator.

Referring now to FIGS. 5–7, a child-safety locking system of a third embodiment is shown to comprise a lock lever type manual lock actuator 313 mounted on the side of the interior door panel 307 in a locking frame 319 (constituting part of the door panel in this embodiment) which is recessed into the door panel. The locking frame 319 includes a shield 321 which defines a pocket 323 (FIGS. 6 and 7) in which the lock lever 313 may be received. The pocket 323 has an opening 325 through which the lock lever 313 may enter the pocket. The opening 325 and lock lever 313 are sized so that when the lock lever is in the pocket 323, there is little space between them. Thus, a finger cannot be inserted into the pocket 323 to move the lock lever 313 back out of the pocket once it enters. The lock lever 313 has an octagonal opening 327 at its inner end which is sized for receiving an octagonally shaped end 329A of a lock stud 329 such that the lock lever and lock stud are connected for conjoint rotation about the longitudinal axis of the lock stud. A cap screw 331 fastens the lock lever 313 on the lock stud 329, which extends into the interior of the door for connection, by way of a lock rod to the locking mechanism (not shown). Rotation of the lock lever 313 operates the locking mechanism to lock and unlock the latch (not shown).

The child-safety locking system of the third embodiment is also capable of switching between a normal lock mode and a guard lock mode. The cooperating octagonal opening 327 in the lock lever 313 and octagonal end 329A of the lock stud 329 permit the lock lever to be fixed in several angular positions on the lock stud. In the normal lock mode, the lock lever 313 is fastened to the lock rod 329A by the cap screw 331 such that the lock lever is secured in a first angular orientation relative to the lock stud 329. In the first angular orientation, the lock lever 313 remains outside of the pocket 323 in both its locked and unlocked position. The unlocked position of the lock lever 313 mounted on the lock stud 329 is shown in phantom lines in FIG. 5. The locked position of the lock lever 313 in the first orientation is illustrated in solid lines. Thus, it may be seen that the lock lever 313 is readily manually accessible in its locked position in the normal lock mode to be moved back to its unlocked position.

To operate in the guard lock mode, the cap screw 331 and lock lever 313 are removed from the lock stud 329 in the unlocked position of the lock lever (FIG. 7). The lock lever 313 is turned in a clockwise direction toward the shield 331 to a second angular orientation relative to the lock stud 329, and placed back onto the lock stud. The cap screw 331 is reapplied to the lock stud 329 to secure the lock lever 313 in the second angular orientation. In the unlocked position of the lock lever 313 in the guard lock mode, the lever has the position shown in solid lines in FIG. 5, where it is accessible to be pushed in a clockwise direction to its locked position (shown in hidden lines in FIG. 5) in the pocket 323 defined by the shield 321. As shown in FIG. 6, the close spacing between the lock lever 313 and the shield 321 prevents a finger or other object from being inserted through the opening 325 past the lock lever to move it back to the unlocked position. Thus, the door 101 cannot be manually unlocked in the guard lock mode.

A hump 341 in the lower part of the locking frame 319, located just in front of the opening 325, blocks any attempt to insert a finger underneath the lock lever 313 in its locked position to move it manually back to its unlocked position. It will be noted that the shield 321 and locking frame 319 are solid in the area surrounding the opening 325 so that there is no other opening besides the opening giving access to the lock lever 313. Thus, referring to FIG. 1 and FIG. 14, the only way to unlock the door 101 in the guard lock mode of the locking system is to use the power locking system 119 controlled from the control panel 116 on the driver's side front door.

Figure 8:
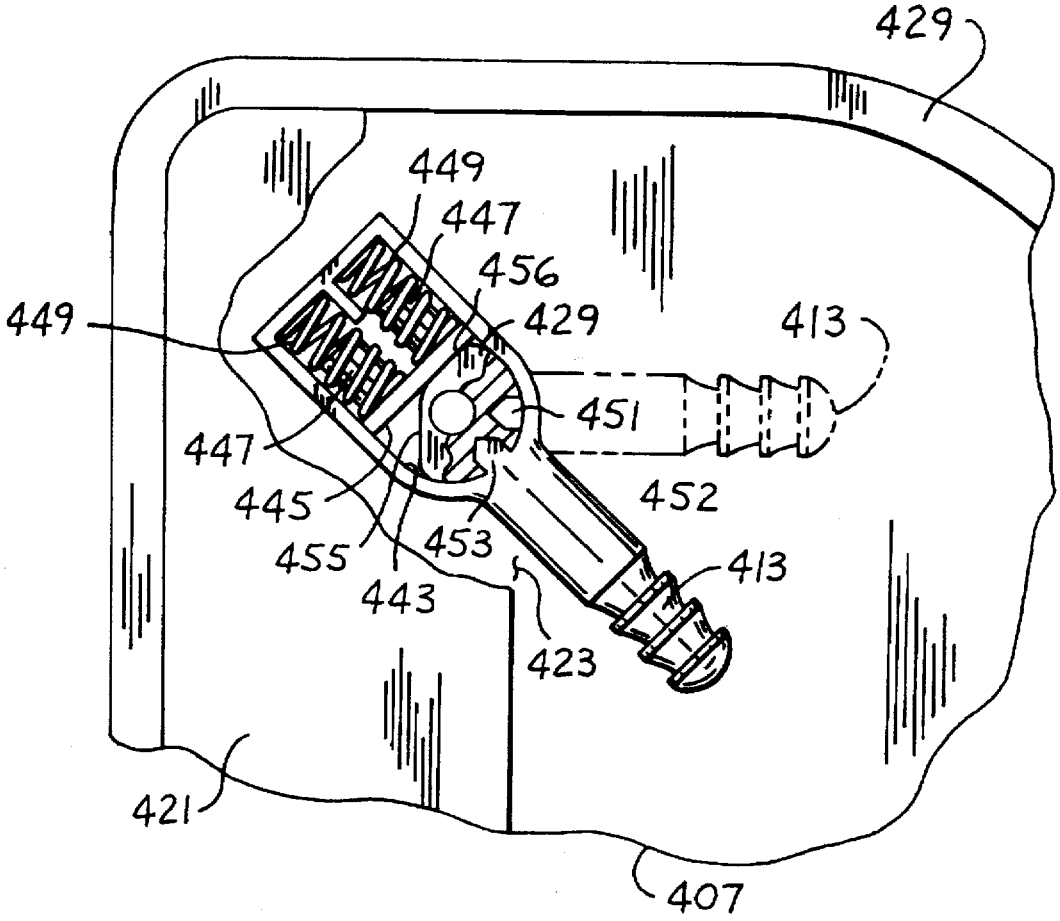
FIG. 8 is an elevation of another lever type manual lock actuator of a child-safety locking system of a fourth embodiment with parts of its shield broken away to show internal construction.

A fourth embodiment of the child-safety locking system (FIG. 8) has a lock lever 413 similar to that of the third embodiment, but has adjustable mounting structure which is more convenient than the cap screw 331 of the third embodiment. The fourth embodiment permits changing the position of the lock lever 413 from the first angular orientation (corresponding to the normal lock mode) to the second angular orientation (corresponding to the guard lock mode) without removing the lock lever from the lock stud 429. The lock lever 413 is shown in its unlocked positions in FIG. 8. The solid line representation illustrates the lock lever 413 in the guard lock mode, and the phantom line representation illustrates it in the normal lock mode.

The lock lever 413 may be selectively clamped onto the lock stud 429 in either the guard lock or normal lock mode. In that regard, one end of the lock lever is formed with an opening 443 sized to receive the end of the lock stud 429. One wall of the opening 443 is defined by a clamp 445 which is slidably mounted on the lock lever 413 for movement generally longitudinally of the lock lever. The side of the clamp 445 opposite the lock stud 429 has a pair of nubs 447 which each receive an end of a respective coil compression spring 449 bearing against the clamp and against a reaction surface of the lock lever generally opposite the clamp. The springs 449 bias the clamp 445 into gripping engagement with the lock stud 429 and are selected to be sufficiently strong to prevent a small child from being able to change the orientation of the lock lever 413 relative to the lock stud. As clamped onto the lock stud 429 in either orientation, the lock lever 413 and lock stud are rotatable conjointly about the axis of the lock stud.

The lock stud 429 has a first aperture 451 and a second aperture 452 sized to receive a locator pin 453 on the lock lever 413 to positively locate the lock lever in the first and second angular orientations relative to the lock stud corresponding to the normal lock and guard lock modes, respectively. The lock stud 429 has two flat surfaces (designated 455 and 456, respectively), a first of which (surface 455) is engaged by the clamp 445 in the normal lock mode of the system and a second of which (surface 456) is engaged by the clamp in the guard lock mode of the system. The flat surfaces 455, 456 permit a secure, positive location of the lock lever 413 relative to the lock stud 429.

The lock lever 413 is adjusted to change the locking system from a normal lock mode to a guard lock mode by pulling outward on the lock lever at its end opposite the lock stud 429 to unseat the locator pin 453 from the first aperture 451. The lock lever 413 is then rotated clockwise relative to the lock stud 429 about the axis of the lock stud until the locator pin 453 is in registration with the second aperture 451. The lock lever 413 is released and the springs 449 and clamp 445 operate to seat the locator pin 453 in the second aperture 452. The lock lever 413 is now joined with the lock stud 429 in the guard lock mode of the locking system. As before in the guard lock mode, the lock lever 413 may be returned to its unlocked position only by operation of the power locking system 119. It is apparent that the foregoing steps may be reversed to change the locking system back to the normal lock mode.

Figure 9:
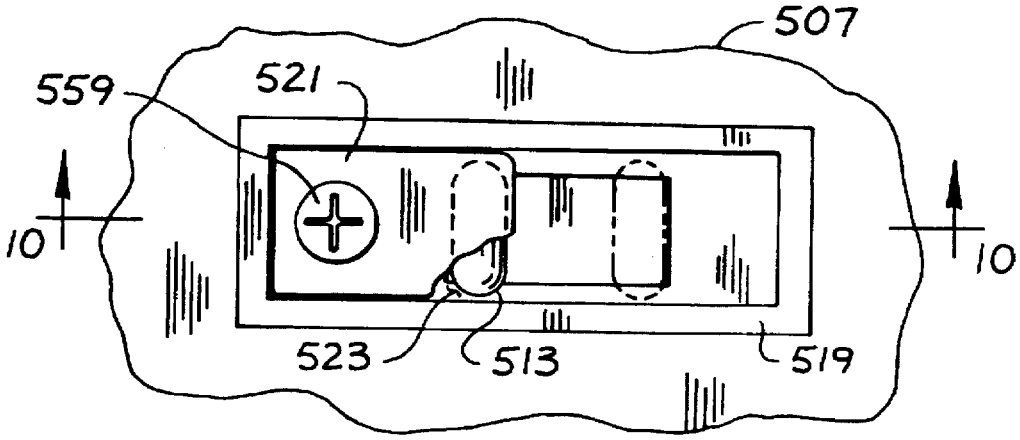
FIG. 9 is a fragmentary elevation of a door showing a slide type manual lock actuator, and a child-safety locking system of a fifth embodiment.
Figure 10:
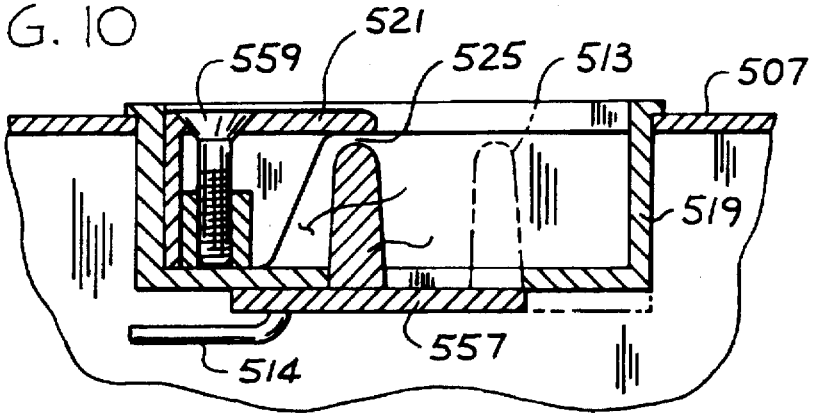
FIG. 10 is a section taken in the plane including line 10—10 of FIG. 9.

A child-safety locking system of a fifth embodiment is shown in FIG. 9–10 to include a slide type manual lock actuator 513 mounted to the side of the interior door panel 507 by a locking frame 519 recessed into the door panel. The locking frame 519 constitutes part of the interior door panel 507 in this embodiment. A slide 513 extending outward from the locking frame 519 is connected to a slide plate 557 behind the locking frame. The slide plate 557 is connected to the locking mechanism 111 by a lock rod 514 such that the slide 513 can be moved translationally along the locking frame 519 to lock and unlock the latch 103. A shield 521 connected to the locking frame 519 by a screw 559 defines with the locking frame a pocket 523 for receiving the slide 513 in its locked position. The pocket 523 has an opening 525 through which the slide 513 passes into the pocket. The opening 525, pocket 523 and slide 513 are sized such that it is not possible to grasp the slide with one's fingers in the locked position. Moreover, the slide 513 cannot be manipulated with a key or similar thin, rigid object in its locked position to move it back to the unlocked position. The slide 513 can be moved back to its unlocked position by operation of the power locking system 119.

Figure 11:
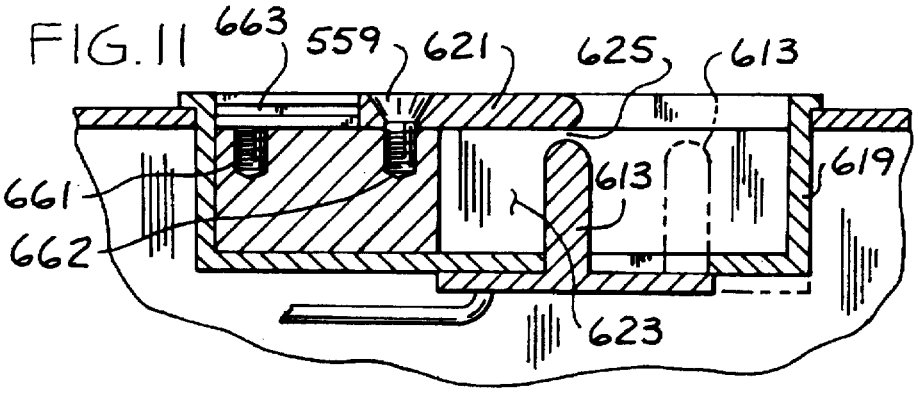
FIG. 11 is section similar to FIG. 10 but showing a child-safety system of a sixth embodiment in a guard lock mode.
Figure 12:
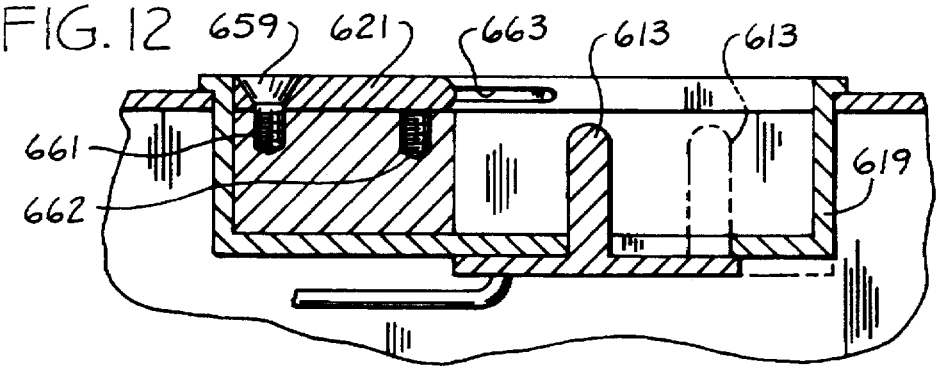
FIG. 12 is the section of FIG. 11 but showing the child-safety locking system in a normal lock mode.

It is possible to convert the locking system of the fifth embodiment to operate in a normal lock mode by removing the shield 521. To do this, the screw 559 is taken out and the shield 521 is removed. However, a sixth embodiment of the present invention shown in FIGS. 11 and 12, is more conveniently switched between guard lock and normal lock modes. The locking system of the sixth embodiment is substantially the same as that of the fifth embodiment except for the construction of the shield 621. The shield 621 of the sixth embodiment is slidable longitudinally of the locking frame 619 between the guard lock mode (FIG. 11) and the normal lock mode (FIG. 12). The shield 621 has tabs (not shown) on each edge which ride in grooves 663 (only one is shown) in the locking frame 619. The shield 621 is secured in either position by a screw 659 received through a single opening in the shield and either of two openings (designated 661 and 662, respectively) in the locking frame 619 corresponding to the guard lock and normal lock modes, respectively. Thus, it may be seen that there are no unused parts to be stored in either the guard lock or normal lock mode because the shield 621 remains attached to the door. In the guard lock mode, the shield 621 cooperates with the locking frame 619 to define a pocket 623 and opening 625 as in the fifth embodiment.

Figure 13:
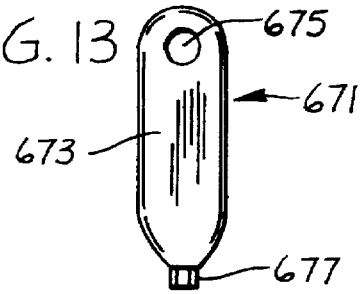
FIG. 13 is an elevation of a key for use in changing the child-safety system of the sixth embodiment between the guard lock and normal lock modes.

Switching the locking system of the sixth embodiment from one lock mode to the other is facilitated by the provision of a hex head key, indicated generally at 671 in FIG. 13, which can be used as a screwdriver to loosen and tighten the screw 659. The key 671 has a wide body 673 which can be easily gripped for turning the key. A hole 675 in the end of the body 673 opposite a head 677 is sized to receive a key chain (not shown). Thus, the key 671 can be conveniently carried around to be used to change the lock mode of the locking system. It is to be understood that the key 671 could also be used with any of the locking systems employing screws to hold the locking system in one lock mode or the other.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A child-safety, power lock door locking system for an automobile, the system comprising a door including an interior door panel, a latch and a handle capable of operating the latch to latch and unlatch the door, a locking mechanism operable to lock and unlock the latch, the door handle being incapable of operating to unlatch the door when the locking mechanism locks the latch, a manual lock actuator mounted on the door for manually actuating the locking mechanism to lock and unlock the latch, the manual lock actuator being capable of movement between a locked position in which the latch on the door is locked and an unlocked position in which the latch on the door is unlocked, the door panel having an opening therein for receiving the manual lock actuator in the locked position so that the manual lock actuator is substantially recessed within the door panel, the manual lock actuator and door panel being sized and shaped such that the manual lock actuator is in closely spaced relation with the door panel in the opening and the manual lock actuator cannot be accessed through the opening for manual movement to the unlocked position, the manual lock actuator comprising a lock lever and a lock rod on which the lock lever is mounted, the lock rod being mounted for rotation on the door and operatively connecting the lock lever to the locking mechanism for actuating the locking mechanism, a power lock actuator for automatically actuating the locking mechanism to lock and unlock the latch from a location remote from the door in the automobile, the power lock actuator being incapable of being activated at the door to unlock the locking mechanism, whereby the door cannot be manually unlocked by operation of the manual lock actuator upon actuation of the locking mechanism to lock the latch, and means for switching the child-safety locking system between a normal lock mode and a guard lock mode, in the normal lock mode the manual lock actuator being disposed in the locked position so that the manual lock actuator may be accessed for manually moving the manual lock actuator to the unlocked position, in the guard lock mode the manual lock actuator being substantially recessed within the door panel in the locked position so that the door cannot be manually unlocked, said switching means being operable to relatively reposition the door panel and manual lock actuator thereby to selectively switch the child-safety locking system between the normal lock mode and the guard lock mode, said switching means comprising adjustable mounting structure for selectively securing the lock lever in a first angular orientation relative to the lock rod corresponding to the normal lock mode and in a second angular orientation relative to the lock rod corresponding to the guard lock mode, the lock lever being arranged with respect to the door panel so that in the unlocked position of the guard lock mode the lock lever is exposed for manual actuation by a passenger in the car to the locked position, and in the locked position of the guard lock mode the lock lever is substantially recessed within the door panel to prevent access for manual actuation by the passenger of the lock lever to the unlocked position.

2. A child-safety locking system as set forth in claim 1 wherein the adjustable mounting structure comprises a clamp, spring means for biasing the clamp into securing engagement with the lock rod and a locator pin, the lock rod having a first aperture therein sized for receiving the locator pin to locate the lock lever in the first angular orientation and a second aperture therein sized for receiving the locator pin to locate the lock lever in the second angular orientation.

3. A child-safety door locking system for use on an automobile door having a latch, a handle capable of operating the latch to latch and unlatch the door, a locking mechanism operable to lock and unlock the latch, the door handle being incapable of operating to unlatch the door when the locking mechanism locks the latch, the child-safety door locking system being capable of being selectively switched between a normal lock mode in which the door can be manually locked and unlocked, and a guard lock mode in which the door cannot be manually unlocked, the child-safety door locking system comprising an interior door panel and a manual lock actuator operatively connected to the locking mechanism for manually actuating the locking mechanism to lock and unlock the latch, the manual lock actuator being capable of movement between a locked position in which the latch on the door is locked and an unlocked position in which the latch on the door is unlocked, the door panel having an opening therein for receiving the manual lock actuator, and means for switching the child-safety locking system between the normal lock mode and the guard lock mode, said switching means being operable to relatively reposition the door panel and manual lock actuator, the door panel and manual lock actuator remaining attached to the door in the guard lock and normal lock modes, in the normal lock mode the manual lock actuator being disposed in the locked position so that the manual lock actuator may be accessed for manually moving the manual lock actuator to the unlocked position, in the guard lock mode the manual lock actuator is substantially recessed within the door panel in the locked position, the manual lock actuator and door panel being sized and shaped such that the manual lock actuator is in closely spaced relation with the door panel in the opening so that in the guard lock mode the manual lock actuator cannot be accessed in its locked position through the opening for manual movement to the unlocked position, the manual lock actuator comprising a lock lever and a lock rod on which the lock lever is mounted, the lock rod being mounted for rotation on the door and operatively connecting the lock lever to the locking mechanism for actuating the locking mechanism, said switching means comprising adjustable mounting structure for selectively securing the lock lever in a first angular orientation relative to the lock rod corresponding to the normal lock mode and in a second angular orientation relative to the lock rod corresponding to the guard lock mode.

4. A child-safety locking system as set forth in claim 3 wherein the adjustable mounting structure comprises a clamp, spring means for biasing the clamp into securing engagement with the lock rod and a locator pin, the lock rod having a first aperture therein sized for receiving the locator pin to locate the lock lever in the first angular orientation and a second aperture therein sized for receiving the locator pin to locate the lock lever in the second angular orientation.

* * * * *